US007306045B1

(12) United States Patent
Moflihi

(10) Patent No.: US 7,306,045 B1
(45) Date of Patent: Dec. 11, 2007

(54) MULTI-STAGE FLUID POWER TURBINE FOR A FIRE EXTINGUISHER

(76) Inventor: Saeed M. Moflihi, 2823 Avenue Z, #1F, Brooklyn, NY (US) 11235

( * ) Notice: Subject to any disclaimer, the term of this patent is extended or adjusted under 35 U.S.C. 154(b) by 0 days.

(21) Appl. No.: 11/439,156

(22) Filed: May 22, 2006

(51) Int. Cl.
*A62C 31/00* (2006.01)

(52) U.S. Cl. ..... 169/70; 169/14; 169/54; 169/15; 169/52; 239/14.1; 239/14.2; 239/380

(58) Field of Classification Search ..... 169/70, 169/14, 15, 54; 239/380, 381, 382, 383, 239/14.2, 14.1, 398, 395
See application file for complete search history.

(56) References Cited

U.S. PATENT DOCUMENTS

| | | | | | |
|---|---|---|---|---|---|
| 2,884,075 | A * | 4/1959 | Poon | 169/48 |
| 2,988,343 | A * | 6/1961 | Edwards et al. | 261/25 |
| 3,428,131 | A * | 2/1969 | Winslow | 169/15 |
| 3,780,812 | A * | 12/1973 | Lambert | 169/15 |
| 4,222,519 | A * | 9/1980 | Kircher et al. | 239/14.2 |
| 4,597,524 | A * | 7/1986 | Albertsson | 239/14.2 |
| 4,901,920 | A * | 2/1990 | Wollin | 239/2.2 |
| 4,907,654 | A * | 3/1990 | Eberhardt | 169/70 |
| 4,976,319 | A * | 12/1990 | Eberhardt et al. | 169/54 |
| 5,062,487 | A * | 11/1991 | Siria et al. | 169/91 |
| 5,787,989 | A * | 8/1998 | Elmenhorst | 169/14 |
| 5,841,943 | A * | 11/1998 | Nosenchuck | 392/385 |
| 6,554,200 | B1 * | 4/2003 | Satonaka | 239/2.2 |
| 6,575,381 | B1 * | 6/2003 | Fujiwara | 239/2.2 |
| 2005/0045306 | A1 * | 3/2005 | Petervary et al. | 165/80.3 |
| 2007/0017722 | A1 * | 1/2007 | St. Louis | 180/116 |

* cited by examiner

*Primary Examiner*—Kevin Shaver
*Assistant Examiner*—Trevor McGraw
(74) *Attorney, Agent, or Firm*—Morland C. Fischer

(57) ABSTRACT

A multi-stage fluid power turbine having application as a fire extinguisher to be ideally carried by a fire truck (e.g., a tanker or a pumper) so as to fight outdoor fires. An impeller and a propeller are located at one end of the fire extinguisher, and a fan is located at the opposite end. The propeller and the fan are mounted on a common inner shaft so as to rotate in a first direction. The impeller is mounted on a hollow outer shaft or tube that surrounds the inner shaft. The impeller includes a plurality of curved blades, each of which having a fluid duct running therethrough. Water under pressure being supplied from a source to the impeller blades is ejected from the fluid ducts thereof and thrust against the blades of the propeller, whereby to impart a rotational force to the propeller and a corresponding rotational force to the fan. The water ejected from the curved impeller blades causes the impeller to rotate in an opposite direction. Accordingly, the propeller breaks up the supply of water ejected from the impeller blades so that a high humidity air and water spray is blown by the fan at high velocity and pressure towards the fire to be extinguished.

20 Claims, 6 Drawing Sheets

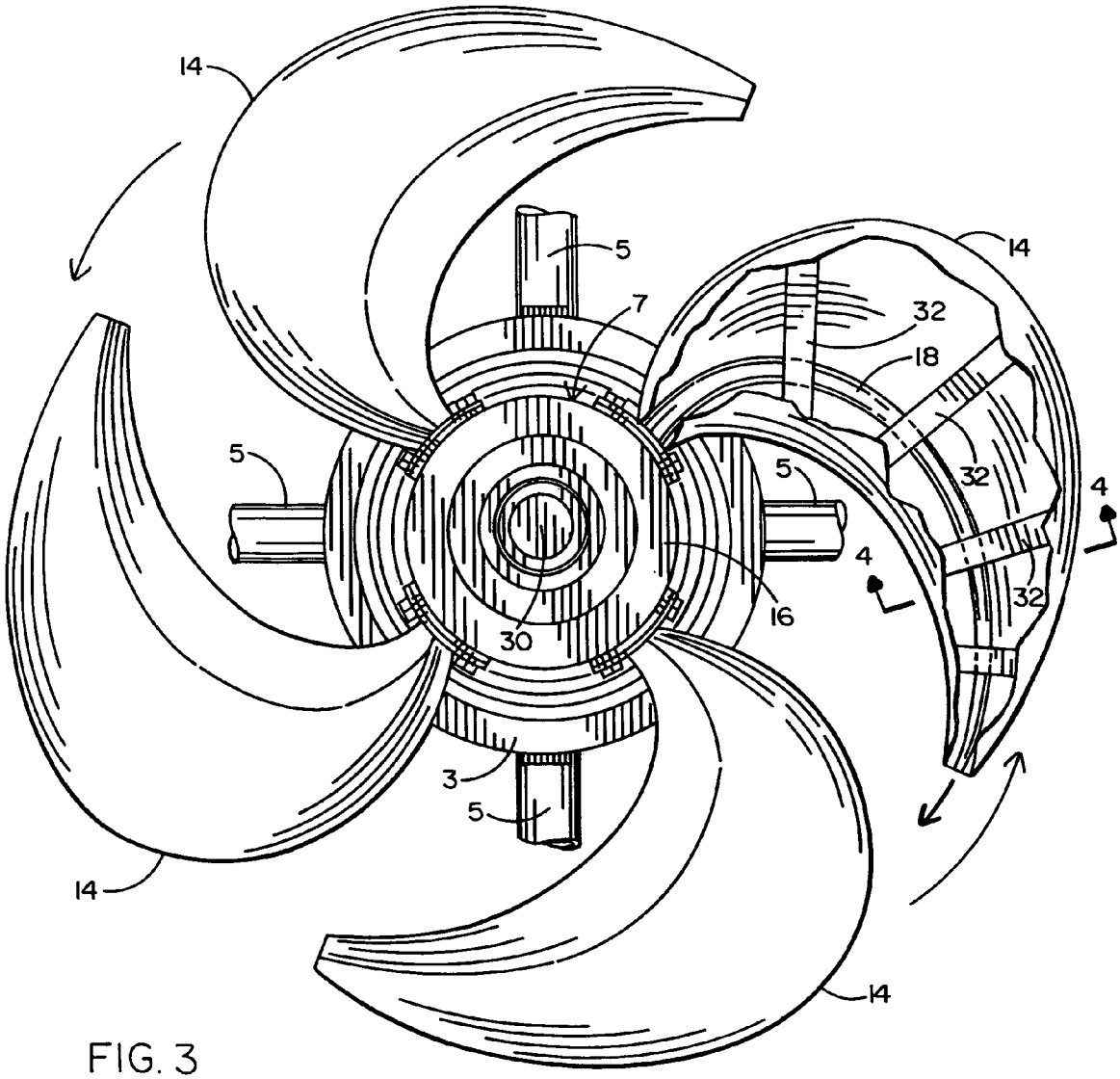
FIG. 3
FIG. 4
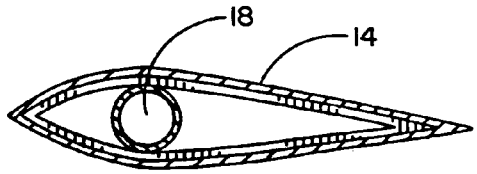

MULTI-STAGE FLUID POWER TURBINE FOR A FIRE EXTINGUISHER

BACKGROUND OF THE INVENTION

1. Field of the Invention

This invention relates to a fire extinguisher that is sized to be ideally mounted atop and carried by a fire truck (e.g., a tanker or a pumper) which transports a water supply to be used for fighting outdoor fires. The fire extinguisher herein disclosed includes an impeller, a propeller and a fan that are axially aligned with one another to form a multi-stage fluid power turbine so that a high humidity air and water spray can be blown at high velocity and pressure towards a fire to be extinguished.

2. Background Art

Large outdoor grass and hillside fires have become a common problem, particularly in areas of California, Texas and Oklahoma. Not only has vast acreage been burned at alarming rates, but homes and private property have been increasingly subjected to damage or destruction. Because such outdoor fires typically burn at high temperatures and are often wind driven, it is important that fire fighters have access to a sufficient volume of water that can be delivered under high pressure and over a wide area so as to adequately control or extinguish the fire.

The same problems exist with large structural fires as well as vehicle and airplane fires. To combat such fires, a large volume of water or other suitable fluid must be delivered to the fire in a relatively short amount of time so as to essentially smother the flames and lower the temperature of the burn site to prevent reignition.

Outdoor fires are sometimes fought with the aid of long, winding hoses that deliver a steady stream of water to the flames. However, such hoses are best used for fighting indoor structural fires where the fires are confined to a room or a single structure. In order to fight a fire, the hose must first be removed from the fire truck, unwound, and then connected to a source of water (e.g., a fire truck or a fire hydrant if one is available). The process of removing and readying a fire hose for use wastes valuable time. Moreover, fire hoses are often strewn about, which can pose a safety hazard for fire fighters who must move quickly around the scene without always being able to watch where they step. In this same regard, more than a single fire fighter is often required to attach and maneuver a fire hose through which a large volume of water is carried.

What is desirable is a more efficient way to fight certain outdoor fires in addition to or without the use of a conventional fire hose and the inherent disadvantages associated therewith.

SUMMARY OF THE INVENTION

Briefly, and in general terms, a multi-stage fluid power turbine is disclosed having particular application as a fire extinguisher for fighting outdoor fires. The fire extinguisher is sized to be ideally mounted atop and carried by a fire engine (e.g., a tanker or a pumper) to the scene of the fire. The fire extinguisher includes an impeller, a propeller and a fan that are axially aligned with one another and rotate within a turbine housing so that a high humidity air and water spray can be blown at high velocity and pressure towards the fire to be extinguished.

The impeller is located immediately behind the propeller at the front of the fire extinguisher. A supply of water is delivered from the fire truck or fire hydrant to a water collector and distributor within the turbine housing. The water is then carried through the collector and distributor into respective fluid ducts that run through curved blades of the impeller. In this regard, each of the blades of the impeller is hollow so as to accommodate a fluid duct running to the outer tip thereof. The water which is thrust from the fluid ducts at the tips of the curved impeller blades impacts the blades of the propeller, whereby to impart a rotational force thereto. The propeller blades are angled so as to react to the force of the water such that the impeller and the propeller rotate in opposite directions. The propeller breaks up the water being thrust thereagainst from the impeller blades into droplets so as to be blown towards the fire as a spray.

The fan is located at the rear of the fire extinguisher behind the impeller and the propeller. The fan rotates at high speed to generate a high velocity current by which to blow the high humidity mixture (i.e., spray) of water and air over a wide area to extinguish the fire. According to a preferred embodiment, the numbers of blades of the impeller, propeller and fan are selected according to a ratio of 1 to 2 to 3. The propeller and the fan are mounted on a common shaft and rotate in the same direction and speed, such that a rotation of the propeller (in response to the water being thrust thereagainst from the tips of the impeller blades) causes a corresponding rotation of the fan. The impeller is mounted on an independent outer shaft or hollow tube that surrounds the shaft on which the propeller and fan are mounted. The impeller rotates with the outer shaft (in response to the water which is thrust from the tips of the curved blades thereof) in a direction which is opposite the direction of rotation of the propeller and the fan. The blades of the impeller, propeller and fan are all angled in the same direction towards the front of the fire extinguisher and the fire to be extinguished.

BRIEF DESCRIPTION OF THE DRAWINGS

FIG. 3 shows details of the impeller and fluid ducts which run through respective blades thereof for causing the impeller to rotate in one direction while imparting an opposite rotational force to the propeller;

FIG. 4 is a cross-section taken along lines 4-4 of FIG. 3;

DESCRIPTION OF THE PREFERRED EMBODIMENT

Figure 1:
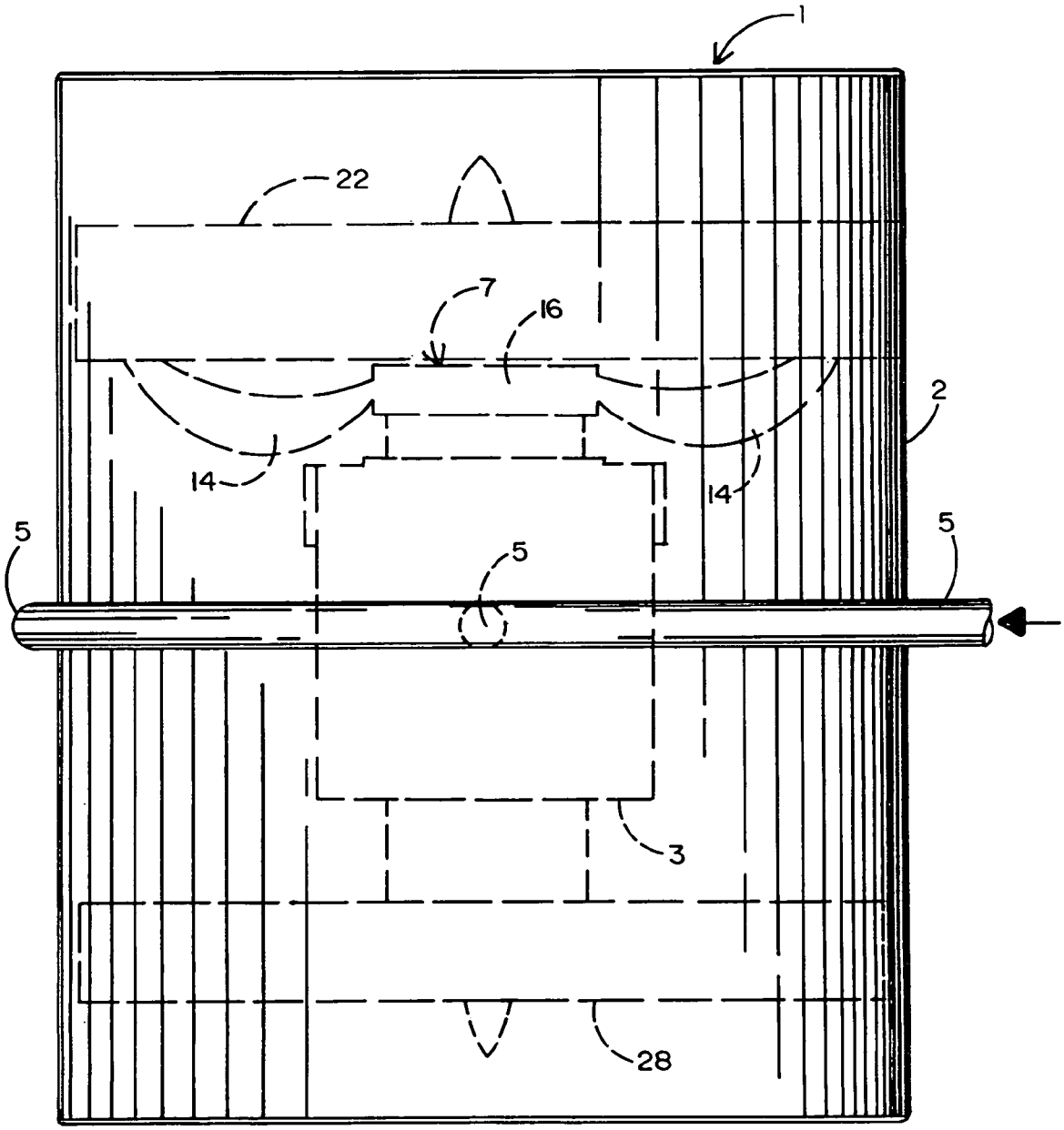
FIG. 1 shows a housing for a multi-stage fluid power turbine having particular application as a fire extinguisher for extinguishing an outdoor fire.
Figure 2:
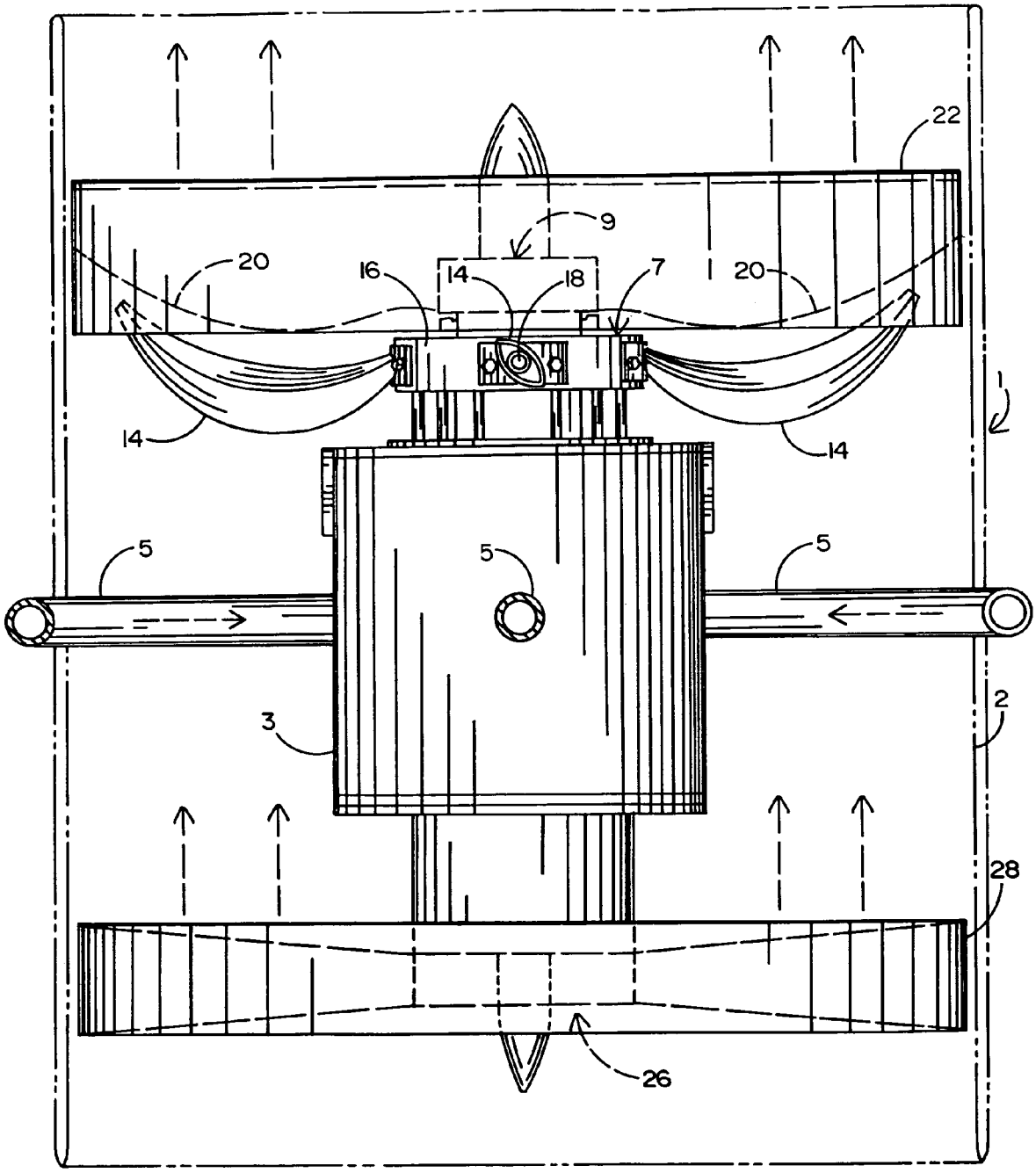
FIG. 2 shows the axial alignment of an impeller, a propeller and a fan within the turbine housing of FIG. 1 to generate a high humidity air and water spray to be blown at high velocity and pressure towards a fire.

Referring initially for FIGS. 1 and 2 of the drawings, there is shown a fire extinguisher 1 according to a preferred embodiment that is adapted to generate a high humidity spray including a mixture of air and water to be blown at high velocity and high pressure towards an outdoor fire such as that which has been known to consume large amounts of acreage. However, the fire extinguisher 1 of this invention may also be used to fight other fires such as those which have known to be engulf a motor vehicle, aircraft or large structure. To this end, it is contemplated that the fire extinguisher 1 will be relatively compact (i.e., approximately 3 meters wide) so as to be ideally mounted atop and carried by a fire engine (e.g., a tanker or a pumper) whereby the fire extinguisher 1 will have ready access to the water transported thereby. However, the fire extinguisher herein disclosed may be transported to a fire by any other suitable means so long as a source of municipal or portable water is available.

The fire extinguisher 1 includes a turbine housing 2 within which is centrally disposed a water collector and distributor 3. The water collector and distributor 3 receives water from the source by way of one or more water inlets 5. The water inlets 5 are coupled to a fire truck, fire hydrant, or similar source that is capable of delivering a continuous supply of water, under pressure, to the collector and distributor 3.

The fire extinguisher 1 includes an impeller 7 and a propeller 9 that are axially aligned face-to-face one another ahead of the water collector and distributor 3 at the front of fire extinguisher 1. A fan 26 that is also axially aligned with the impeller 7 and the propeller 9 is located behind the collector and distributor 3 at the rear of the fire extinguisher 1. The impeller 7 is located immediately behind the propeller 9 for an important purpose which will soon be described. The water collector and distributor 3 communicates with the impeller 7 through a plurality of water passages (designated 36 and best shown in FIG. 7). The impeller 7 includes a set of (e.g., four) evenly spaced blades 14 that are connected to a hub 16. As will be explained in greater detail when referring to FIG. 3, each of the blades 14 of the impeller 7 has a fluid duct 18 running completely therethrough and lying in fluid communication with the water collector and distributor 3 via the water passages 36. Pressurized water is thrust from the fluid ducts 18 at the tips of the blades 14 of the impeller 7 against the adjacent blades 20 of the propeller 9. The water which impacts the blades 20 causes the propeller 9 to rotate in front of the impeller 7.

According to the preferred embodiment, the number of blades 20 of the propeller 9 at the front of the fire extinguisher 1 is at least twice the number of blades 14 of the impeller 7. In the example shown in FIGS. 1 and 2, the impeller 7 has four evenly spaced blades 14 and the propeller 9 has (at least) eight evenly spaced blades 20. What is more, the pitch of the blades 20 is established such that the impeller 7 and propeller 9 will rotate in opposite directions.

The propeller 9 is surrounded by a shroud 22. The shroud 22 helps to direct the water which exits the fluid ducts 18 of the impeller 7 to be thrust against the blades 20 of the propeller 9 to cause a rotation thereof. The shroud 22 also spreads the mixture of air and water spray that is generated by the fire extinguisher 1 over a wide area.

Located at the rear of the fire extinguisher 1 in axial alignment with the impeller 7 and propeller 9 is the fan 26. The fan 26 is surrounded by a shroud 28. The fan 26 is mounted so as to rotate with the propeller 9 at very high speeds (e.g., 40,000 RPM) to generate a large volume of air to be pushed towards the impeller 7 and propeller 9 at the front of the fire extinguisher 1. The air generated by the fan 26 blows the mixture of air and water as a high humidity spray from the propeller 9 towards the fire to be extinguished.

FIG. 3 of the drawings shows details of the impeller 7 which receives a continuous supply of water from the water collector and distributor 3 within turbine housing 2. As previously described, water is pumped to the collector and distributor 3 through one or more water inlets 5. Water from the collector and distributor 3 is then supplied to respective fluid ducts 18 which run completely through the blades 14 of impeller 7 to be thrust from the outer tips thereof so as to impact and thereby impart a rotational force against the blades 20 of the propeller 9 (of FIGS. 1 and 2).

Figure 7:
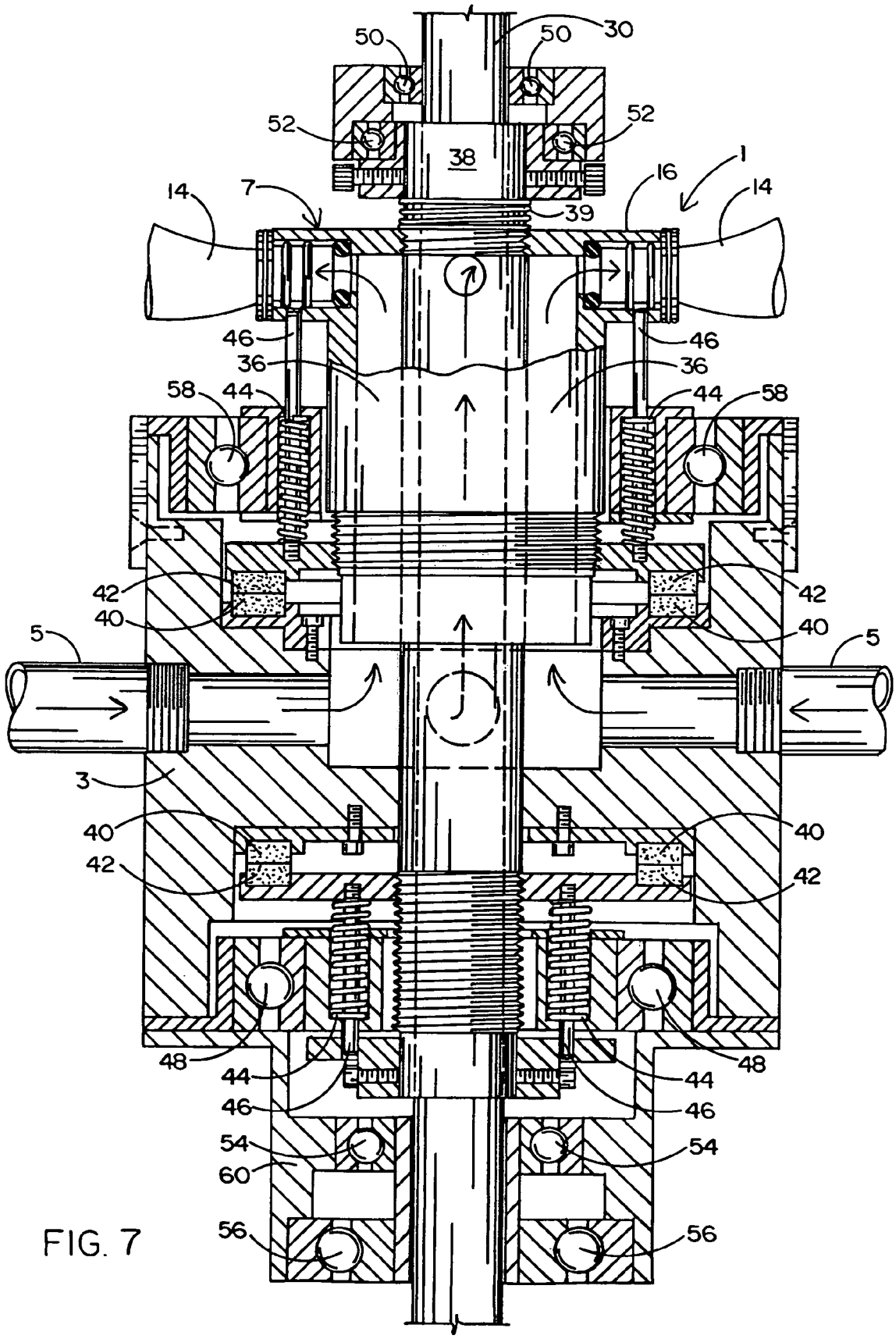
FIG. 7 is a cross-section of the turbine housing of the fire extinguisher showing the water collection and distribution means thereof and the inner and outer shafts on which the impeller, the fan, and the propeller are mounted for rotation.

The impeller 7 is mounted for rotation with a shaft 38 (best shown in FIG. 7). In the present embodiment, the impeller 7 will rotate in a counter-clockwise direction. The action (i.e., rotation) of the impeller 7 causes a reaction (i.e., counter-rotation) of the propeller 9 which is mounted for rotation with an independent shaft (30 in FIG. 7). That is, and as was also previously described, the blades 20 of the propeller 9 are angled so that the propeller will rotate in a clockwise direction in response to the impact of the water being thrust thereagainst from the fluid ducts 18 at the outer tips of the impeller blades 14. The action-reaction effect produced by the water being ejected from the impeller 7 and thrust against the propeller 9 creates a clashing multi-stage fluid power turbine within the turbine housing 2 of FIGS. 1 and 2.

The blades 14 of the impeller 7 are preferably hollow shells that are manufactured from stainless steel, or the like. A series of struts 32 extend transversely across the hollow interior of each blade 14 to provide structural support and reinforcement. A (e.g., stainless steel) fluid duct 18 (best shown in FIG. 4) runs through the hollow interior of each blade 14 to supply water to the tip thereof to be ejected from and thrust against the blades of propeller 9 to cause a counter-rotation thereof as earlier described. The blades 14 of the impeller 7 shown in the example of FIG. 3 are curved in a clockwise direction, such that the water ejected from the blade tips induces a counter-clockwise rotation of the impeller 7 and its shaft 38. A counter-clockwise rotation of the impeller 7 imparts a corresponding clockwise rotation to the propeller 9 and its shaft 30.

Figure 5:
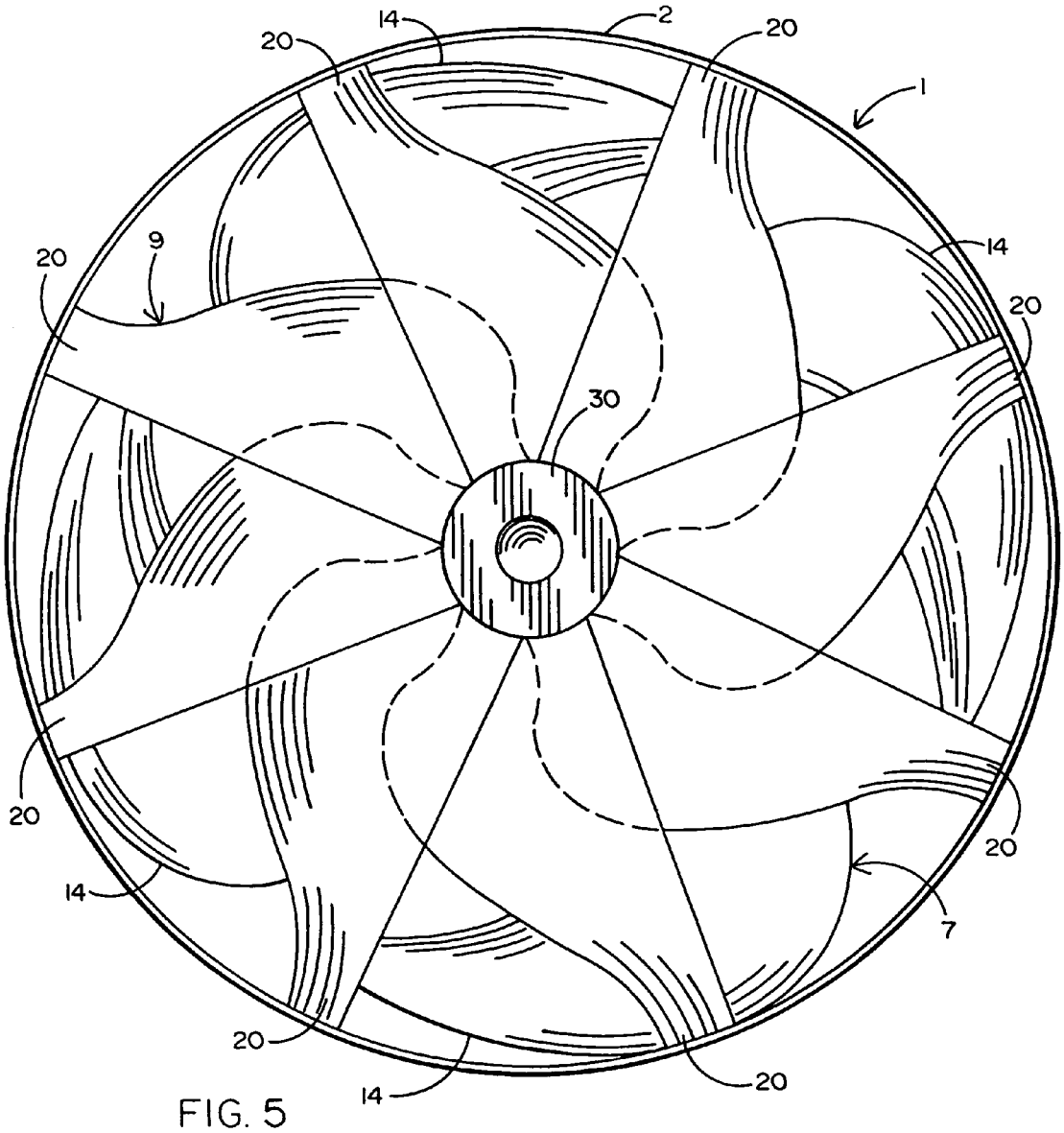
FIG. 5 shows the alignment of the impeller and the propeller located one behind the other at the front of the turbine housing of the fire extinguisher.

Turning to FIG. 5 of the drawings, there is shown the axial alignment of the impeller 7 and the propeller 9 one behind the other by which the fire extinguisher 1 is capable of blowing a large volume of high humidity air (i.e., a mixture of air and water) at high velocity and pressure towards a fire to be extinguished. The impeller 7 and propeller 9 are shown in FIG. 5 with the shroud (designated 22 in FIGS. 1 and 2) removed from around the propeller 9. As was earlier disclosed, the propeller 9 is positioned immediately ahead of the impeller 7 and includes (at least) twice as many blades. Therefore, in the present example, the impeller 7 includes four blades 14 and the propeller 9 includes eight blades 20. However, it is to be understood that the precise number of the blades 14 and 20 of the impeller 7 and the propeller 9 is not to be regarded as a limitation of this invention, although the number of blades is preferably maintained in a ratio of (at least) 1 to 2.

As earlier described, a rotation of the impeller 7 imparts a counter-rotation to the propeller 9 in response to the water which is ejected from the fluid ducts 18 at the tips of the blades 14 of impeller 7 and thrust against the blades 20 of the propeller 9. In this case, with the blades 14 of the impeller 7 being curved in the manner shown in FIG. 3, the impeller 7 will rotate in a counter-clockwise direction so that the propeller 9 will rotate in a clockwise direction. Nevertheless, the precise directions in which the impeller and propeller 7 and 9 rotate is not to be considered a limitation of this invention so long as the propeller and impeller rotate in opposite directions.

Figure 6:
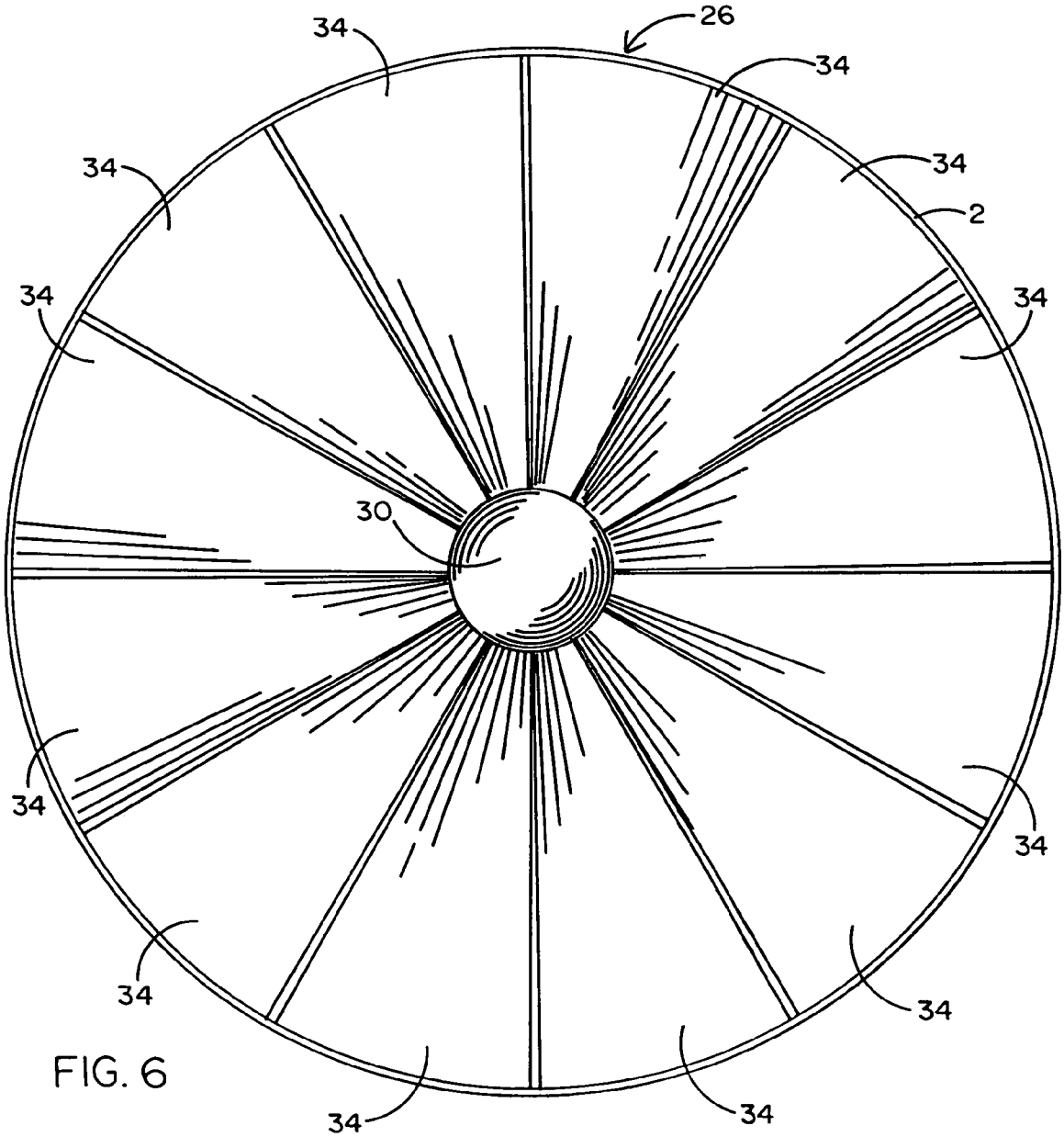
FIG. 6 shows the close spacing of the blades of the fan located at the rear of the turbine housing of the fire extinguisher.

Referring now to FIG. 6 of the drawings, the fan 26 is shown with the shroud (designated 28 in FIG. 2) removed to illustrate a set of closely and uniformly spaced (e.g., stainless steel) blades 34. As is best shown in FIG. 2, the fan 26 is located within the turbine housing 2 at the rear of the fire extinguisher 1 behind the impeller 7 and the propeller 9. The blades 34 of fan 26 are angled so as to push fan air towards the front of the fire extinguisher 1 so that the high humidity spray generated by the oppositely rotating impeller 7 and propeller 9 can be blown towards the fire to be extinguished. In the present example of FIG. 6, the fan 26 has a total of twelve blades. Therefore, it may be appreciated that the numbers of blades carried by the impeller 7, the propeller 9, and the fan 26 are ideally selected according to a 1 to 2 to 3 ratio. In this same regard, to effectively blow a uniform mixture of air and high humidity towards the fire, the pitch of the blades 14, 20 and 34 of the impeller 7, propeller 9 and fan 26 are slanted in the same direction towards the front of the fire extinguisher 1 and the fire to be extinguished.

FIG. 7 of the drawings is a cross-section of the fire extinguisher 1 showing details of the water distribution path from a source of water (e.g., a fire truck or a fire hydrant) for causing a rotation of the impeller 7 which imparts a counter-rotation to both the propeller 9 and the fan 26 so that a high humidity air and water spray can be blown at high velocity and pressure towards the fire to be extinguished. As was previously disclosed, water under pressure is supplied from a suitable source through the water collector and distributor 3 by way of water inlets 5. The water collector and distributor 3 includes water passages 36 therethrough that communicate with the fluid ducts (designated 18 in FIGS. 3 and 4) that run to the tips of the blades 14 of impeller 7.

The propeller 9 (of FIGS. 1 and 2) at one end of the fire extinguisher 1 and the fan 26 (of FIGS. 1 and 2) at the opposite end are mounted on a common shaft 30. Therefore, a rotation of the propeller 9 (in response to the water being thrust against the blades thereof by the impeller 7) causes a corresponding rotation of the fan 26, such that the propeller 9 and fan 26 rotate in an identical direction and at an identical speed. As previously described, the impeller 7 lying immediately behind the propeller 9 rotates in an opposite direction in response to the water that is ejected from the fluid ducts 18 at the tips of the curved impeller blades 14. Therefore, the impeller 7 is mounted on a shaft 38 which is independent from the shaft 30 on which the propeller 9 and fan 26 are mounted.

In the example of FIG. 7, the shaft 38 on which the impeller 7 is mounted is a hollow tube that surrounds the shaft 30. A main coil spring 39 surrounds the outer shaft 38 at the front of the fire extinguisher 1 between the propeller and the impeller so as to exert a rearward pushing force on the impeller 7. Each of the inner and outer shafts 30 and 38 of fire extinguisher 1 extend longitudinally through the water collector and distributor 3. The water passages 36 which extend through collector and distributor 3 between the water inlets 5 and the blades 14 of impeller 7 are located at the exterior of and run axially along the outer shaft 38. The water collector and distributor 3 and the water inlets 5 remain stationary within the turbine housing 2 (of FIGS. 1 and 2) during the rotation of the inner and outer shafts 30 and 38.

To facilitate a rotation of the outer shaft 38 and the impeller 7 mounted thereon as water flows through the axial water passages 36 outside shaft 38, pairs of high pressure mechanical seals (i.e., pads) 40 and 42 are located inside the main collector and distributor 3 at opposite ends of the outer shaft 38. One of the pair of seals 40 is fixed, and the other seal 42 is adapted to rotate with the outer shaft 38. The seals or pads 40 and 42, which are preferably manufactured from a graphite material, function as thrust bearings. A set of coiled shock absorbing springs 44 are wound around and slide over respective thrust pins 46 at opposite ends of the water collector and distributor 3. The springs 44 and the main spring 39 surrounding shaft 38 exert a pushing force against each of the rotating seals 42 of the pairs of seals 40 and 42 and thereby bias the rotating seals 42 towards a face-to-face alignment with the fixed seals 40. The springs 44 absorb vibrations that are generated during rotation of the shafts 30 and 38 when water is pumped through the water passages 36 of water collector and distributor 3. To this end, the springs 44 are supported to rotate with the rotating ones 42 of the pairs of seals 40 and 42 as well as the impeller 7 and the outer shaft 38 which carries the impeller. Ball bearings 48 and 58 are provided to accommodate the rotation of the rotating seals 42 and the shock absorbing springs 44 interfaced therewith.

The fire extinguisher 1 is provided with additional ball bearings to minimize vibration and friction in response to the rotation of the shafts 30 and 38. In particular, ball bearings 50 are located at the front of the fire extinguisher 1 to accommodate a rotation of the front end of the inner shaft 30 and the propeller 9 that is mounted thereon. Ball bearings 52 are also located at the front of the fire extinguisher 1 to accommodate a rotation of the front end of the outer shaft 38 and the impeller 7 that is mounted thereon. Ball bearings 54 and 56 are located within a shaft sleeve 60 at the rear of the fire extinguisher 1 to accommodate a rotation of the rear end of the inner shaft 30 and the fan 26 that is mounted thereon.

The invention claimed is:

1. A fire extinguisher to blow a mixture of water and air towards a fire, said fire extinguisher comprising:

a propeller;

a water inlet to carry a supply of water under pressure;

an impeller communicating with said water inlet to direct the water under pressure supplied by said water inlet against said propeller, said propeller rotating so as to break up the supply of water under pressure into water droplets; and a fan aligned with said propeller, said fan rotating so as to blow high velocity air towards said propeller for causing a mixture of the water droplets and the high velocity air to be blown towards the fire, wherein said propeller and said fan are coupled to a common shaft so as to rotate in a first direction and said impeller is coupled to a different shaft so as to rotate in an opposite direction.

2. The fire extinguisher recited in claim 1, wherein said impeller is located between and axially aligned with said propeller and said fan, said impeller directing the supply of water under pressure carried by said water inlet against the propeller by which to cause the propeller to rotate so as to break up the supply of water under pressure into the water droplets.

3. The fire extinguisher recited in claim 1, wherein each of said impeller, said propeller, and said fan has a number of blades, the number of blades of said propeller being at least twice the number of blades of said impeller.

4. The fire extinguisher recited in claim 1, wherein each of said impeller, said propeller, and said fan has a number of blades according to a ratio of 1 to 2 to 3.

5. The fire extinguisher recited in claim 1, wherein the different shaft to which said impeller is coupled is a hollow tube that surrounds the common shaft to which said propeller and said fan are coupled.

6. The fire extinguisher recited in claim 5, wherein said impeller communicates with said water inlet by way of a water passage located at the exterior of and running axially along said impeller shaft.

7. The fire extinguisher recited in claim 1, wherein each of said propeller and said impeller includes a plurality of blades, each of the blades of said impeller having a fluid duct running therethrough and lying in fluid communication with said water inlet, such that the supply of water under pressure carried by said water inlet is ejected from said fluid ducts and thrust against the blades of said propeller for imparting a rotational force to said propeller blades and thereby causing said propeller to rotate.

8. The fire extinguisher recited in claim 7, wherein the plurality of blades of said impeller are curved, and said fluid ducts run completely through said impeller blades so that the supply of water carried by said water inlet is ejected from the tips of said impeller blades and thrust against the plurality of blades of said propeller for imparting said rotational force to said propeller blades and causing said impeller and said propeller to rotate in opposite directions.

9. The fire extinguisher recited in claim 8, wherein said propeller and said fan are coupled to a common shaft, such that the rotation of said propeller is imparted to said fan for causing each of said propeller and said fan to rotate in the same direction and at the same speed.

10. The fire extinguisher recited in claim 1, wherein each of said impeller, said propeller, and said fan has a number of blades, the pitch of each of said numbers of blades being slanted in the same direction towards the fire to be extinguished.

11. The fire extinguisher recited in claim 1, further comprising a plurality of shock absorbers coupled to and rotating with said impeller, said shock absorbers reducing the vibration caused by the rotation of said impeller and the direction by said impeller of the supply of water carried by said water inlet against said propeller.

12. The fire extinguisher recited in claim 11, further comprising a plurality of pairs of bearing pads, a first of said pairs of bearing pads remaining stationary, and the other pad of said pairs of bearing pads rotating with said plurality of shock absorbers and said impeller relative to said first pad.

13. The fire extinguisher recited in claim 12, wherein each of said plurality of shock absorbers includes a respective coupling pin and a respective spring wound around said coupling pin, said coupling pin extending between said impeller and the rotating pad of one of said pairs of bearing pads, and said spring urging said rotating pad of said one pair of bearing pads towards and into engagement with the stationary pad thereof.

14. A fire extinguisher to blow a mixture of water and air towards a fire, said fire extinguisher comprising:

a water inlet to carry a supply of water under pressure;

an impeller having a plurality of blades and each of said plurality of blades having a fluid duct communicating with said water inlet to receive the supply of water under pressure carried thereby;

a propeller having a plurality of blades and being positioned ahead of said impeller and closer to the fire to be extinguished; and a fan having a plurality of blades and being positioned behind each of said impeller and said propeller and farthest from the fire to be extinguished, said impeller rotating such that the supply of water under pressure carried by said water inlet is ejected from the fluid ducts of said plurality of impeller blades and thrust against the plurality of blades of said propeller to impart a rotational force to said propeller blades to cause said propeller to rotate and thereby break up said supply of water under pressure into water droplets, and said fan rotating to blow high velocity air towards said propeller for causing a mixture of the water droplets and the high velocity air to be blown towards the fire.

15. The fire extinguisher recited in claim 14, wherein said propeller and said fan are mounted on a common shaft such that the rotation of said propeller is imparted to said fan for causing each of said propeller and said fan to rotate at the same speed and in the same direction.

16. The fire extinguisher recited in claim 15, wherein said impeller is mounted on a shaft that surrounds the shaft on which said propeller and said fan are mounted.

17. The fire extinguisher recited in claim 16, wherein said impeller rotates in a direction which is opposite to the direction of rotation of said propeller and said fan.

18. The fire extinguisher recited in claim 14, wherein the plurality of blades of said impeller are curved, and said fluid ducts run completely through said impeller blades so that the supply of water under pressure carried by said water inlet is ejected from the tips of said impeller blades and thrust against the plurality of blades of said propeller for imparting said rotational force to said propeller blades and causing said impeller and said propeller to rotate in opposite directions.

19. The fire extinguisher recited in claim 14, further comprising a plurality of shock absorbers coupled to and rotating with said impeller, said shock absorbers reducing the vibration caused by the rotation of said impeller and the ejection by said plurality of impeller blades of the supply of water under pressure carried by said water inlet against said plurality of propeller blades.

20. A fire extinguisher to blow a mixture of water and air towards a fire, said fire extinguisher comprising:

a propeller;

a water inlet to carry a supply of water under pressure;

an impeller communicating with said water inlet to direct the water under pressure supplied by said water inlet against said propeller, said propeller rotating so as to break up the supply of water under pressure into water droplets; and a fan rotating so as to blow high velocity air towards said propeller for causing a mixture of the water droplets and the high velocity air to be blown towards the fire, wherein said propeller and said fan rotate in a first direction and said impeller rotates in an opposite direction, said propeller, said impeller and said fan being axially aligned with one another with said propeller being positioned ahead of each of said impeller and said fan so as to lie closest to the fire to be extinguished, and said fan being positioned behind each of said propeller and said impeller to lie farthest from the fire to be extinguished, whereby said propeller is caused to rotate by the water under pressure being directed thereagainst by said impeller.

* * * * *